US012544818B2

(12) United States Patent
Degenhardt et al.

(10) Patent No.: US 12,544,818 B2
(45) Date of Patent: Feb. 10, 2026

(54) STAMPING TOOL WITH A SUB PAD WITHIN A FORMING STEEL AND METHOD OF FORMING A PANEL FROM A SHEET METAL WORKPIECE

(71) Applicant: Ford Motor Company, Dearborn, MI (US)

(72) Inventors: Robert Vaughn Degenhardt, Belleville, MI (US); Mark Broadworth, Sterling Heights, MI (US); Rudolf Gerich, Macomb Township, MI (US); Evangelos Liasi, Royal Oak, MI (US); Christian Richard Genereux, Brighton, MI (US)

(73) Assignee: Ford Motor Company, Dearborn, MI (US)

( * ) Notice: Subject to any disclaimer, the term of this patent is extended or adjusted under 35 U.S.C. 154(b) by 299 days.

(21) Appl. No.: 18/184,993

(22) Filed: Mar. 16, 2023

(65) Prior Publication Data

US 2024/0307943 A1 Sep. 19, 2024

(51) Int. Cl.

| | |
|---|---|
| ***B21D 22/22*** | (2006.01) |
| ***B21D 22/10*** | (2006.01) |
| ***B21D 53/88*** | (2006.01) |

(52) U.S. Cl.

CPC ..... *B21D 22/10* (2013.01); *B21D 53/88* (2013.01)

(58) Field of Classification Search

CPC ..... B21D 22/22; B21D 22/02; B21D 22/06; B21D 37/10; B21D 37/12

See application file for complete search history.

(56) References Cited

U.S. PATENT DOCUMENTS

| | | | |
|---|---|---|---|
| 4,365,499 | A | 12/1982 | Hirota et al. |
| 2010/0064759 | A1 | 3/2010 | Kondo et al. |
| 2013/0205863 | A1 | 8/2013 | Loesch |

FOREIGN PATENT DOCUMENTS

| | | | |
|---|---|---|---|
| CN | 106734603 | 5/2017 | |
| WO | WO-2015136168 A1 * | 9/2015 | ..... B21D 22/22 |

* cited by examiner

*Primary Examiner* — Debra M Sullivan

(74) *Attorney, Agent, or Firm* — Burris Law, PLLC

(57) ABSTRACT

A stamping tool includes a lower pad, upper pad, forming steel, and sub-pad. The lower pad includes a lower forming surface recessed in a first direction between a first lower pad surface and the second lower pad surface. The upper pad is movable along a second direction. In an extended position, the upper pad holds a workpiece against the first lower pad surface. The forming steel includes a first forming surface and is movable along the first direction. In an extended position, the forming steel is received in the recess. The sub-pad is coupled to the forming steel such that the forming steel moves the sub-pad in the first direction as the forming steel moves from the retracted position to an intermediate position in which the sub-pad holds the workpiece against the second lower pad surface while the forming steel continues to move to the extended position.

19 Claims, 5 Drawing Sheets

STAMPING TOOL WITH A SUB PAD WITHIN A FORMING STEEL AND METHOD OF FORMING A PANEL FROM A SHEET METAL WORKPIECE

FIELD

The present disclosure relates to a stamping tool for forming a sheet metal workpiece and to a method of forming a panel from a sheet metal workpiece using the stamping tool.

BACKGROUND

The statements in this section merely provide background information related to the present disclosure and may not constitute prior art.

Secondary forming, such as flanging, reforming, and redrawing, is often required in sheet metal forming operations. For example, one or more of these processes are typically required for closure panels of a vehicle. When attempting to achieve some complex geometries, unwanted material may become trapped by the stamping tools in a way that results in large negative strains or lack of stretch in the sheet metal material. This can be especially true for more brittle materials such as aluminum sheet metal. This trapped material can cause unacceptable wrinkles on sheet metal panels.

The stamping tool and method of the present disclosure remedy these and other issues with typical stamping processes.

SUMMARY

This section provides a general summary of the disclosure and is not a comprehensive disclosure of its full scope or all of its features.

According to one form, the present disclosure provides for a stamping tool for forming a panel from a sheet metal workpiece. The stamping tool includes at least one lower pad, an upper pad, a forming steel, and a sub-pad. The at least one lower pad includes a first lower pad surface, a lower forming surface, and a second lower pad surface. The lower forming surface at least partially defines a recess between the first lower pad surface and the second lower pad surface. The recess is recessed in a first direction from the first lower pad surface and the second lower pad surface. The upper pad includes a first upper clamp surface. The upper pad is movable relative to the at least one lower pad along a second direction between a retracted pad position and an extended pad position. In the extended pad position, the first upper clamp surface is configured to hold the workpiece against the first lower pad surface. In the retracted pad position, the first upper clamp surface is further from the first lower pad surface than when in the extended pad position. The forming steel includes a first forming surface. The forming steel is movable relative to the at least one lower pad along the first direction between a retracted steel position, an extended steel position, and an intermediate steel position that is between the retracted steel position and the extended steel position. In the extended steel position, the first forming surface is received in the recess. In the retracted steel position, the first forming surface is further from the lower forming surface than when in the extended steel position. The sub-pad includes a second upper clamp surface opposing the second lower pad surface. The sub-pad is coupled to the forming steel such that the forming steel moves the sub-pad in the first direction as the forming steel moves from the retracted steel position to the intermediate steel position and, at the intermediate steel position, the sub-pad is configured to hold the workpiece against the second lower pad surface while the forming steel continues to move to the extended position.

In variations of the above paragraph, which can be implemented individually or in any combination: the stamping tool further includes a biaser that biases the sub-pad relative to the forming steel in the first direction toward the second lower pad surface; the biaser includes at least one of a piston-cylinder assembly and a spring; a biasing force of the biaser is adjustable; the sub-pad is nested within the forming steel such that at least two side surfaces of the sub-pad oppose at least two side surfaces of the forming steel; the at least two side surfaces of the sub-pad includes three side surfaces that oppose three side surfaces of the at least two side surfaces of the forming steel; the sub-pad is surrounded by the forming steel except for in the first direction; the stamping tool further includes a thrust plate coupled to one of the forming steel and the sub-pad and configured to slidingly engage the other of the forming steel and the sub-pad; the stamping tool further includes a keeper plate coupled to the forming steel and configured to slidingly engage a side of the sub-pad that is opposite the thrust plate; the first lower pad surface, the lower forming surface, and the second lower pad surface are surfaces on a common lower pad of the at least one lower pad; an edge of the first lower pad surface aligns with an edge of the recess and an edge of the second lower pad surface aligns with a different edge of the recess; when the forming steel is in the retracted position, the first forming surface is aligned with the second upper clamp surface; the second direction is transverse to the first direction; the first direction and the second direction are coplanar; the second direction is parallel to the first direction; the forming steel further includes a second form surface on an opposite side of the sub-pad as the first forming surface.

According to another form, the present disclosure provides a stamping tool for forming a panel from a sheet metal workpiece. The stamping tool includes a lower pad, an upper pad, a forming steel, a sub-pad, and a biaser. The lower pad includes a first lower pad surface, a lower forming surface, and a second lower pad surface. The lower forming surface at least partially defines a recess between the first lower pad surface and the second lower pad surface. The recess is recessed in a first direction from the first lower pad surface and the second lower pad surface. The upper pad includes a first upper clamp surface. The upper pad is movable relative to the lower pad along a second direction between a retracted pad position and an extended pad position. The second direction is transverse to the first direction. In the extended pad position, the first upper clamp surface is configured to hold the workpiece against the first lower pad surface. In the retracted pad position, the first upper clamp surface is further from the first lower pad surface than when in the extended pad position. The forming steel includes a first forming surface. The forming steel is movable relative to the lower pad along the first direction between a retracted steel position, an extended steel position, and an intermediate steel position that is between the retracted steel position and the extended steel position. In the extended steel position, the first forming surface is received in the recess. In the retracted steel position, the first forming surface is disposed outside of the recess. The sub-pad includes a second upper clamp surface opposing the second lower pad surface. The sub-pad is coupled to the forming steel such that the forming steel moves the sub-pad in the first direction as the forming steel moves from the retracted steel position to the intermediate steel position and, at the intermediate steel position, the sub-pad holds the workpiece against the second lower pad surface while the forming steel continues to move to the extended position. The biaser biases the sub-pad relative to the forming steel in the first direction toward the second lower pad surface.

In a variation of the above paragraph, the sub-pad may be nested within the forming steel such that at least two side surfaces of the sub-pad oppose at least two side surfaces of the forming steel.

In yet another form, the present disclosure provides a method of forming a panel from a sheet metal workpiece. The method includes positioning the workpiece on a lower pad; clamping a first portion of the workpiece between an upper pad and a first lower pad surface of the lower pad; and moving a base of a first forming steel in a first direction from a retracted steel position, through an intermediate steel position, to an extended steel position such that the base moves a sub-pad in the first direction while moving from the retracted steel position to the intermediate steel position, the sub-pad clamps a third portion of the workpiece to a second lower pad surface of the lower pad while the base moves from the intermediate position to the extended position, and a first forming surface of the first forming steel deforms a second portion of the workpiece, that is between the first and second portions, by extending further in the first direction than the sub-pad.

In a variation of the above paragraph, the sub-pad may remain stationary as the base moves from the intermediate steel position to the extended steel position.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
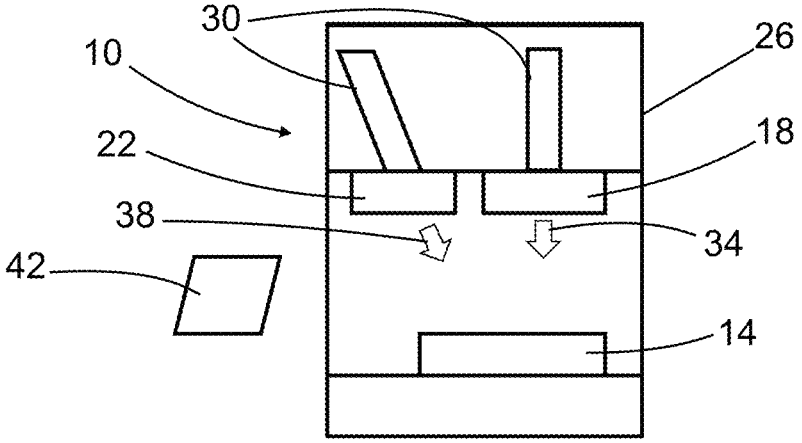
FIG. 1 is a schematic view of a stamping tool in accordance with the teachings of the present disclosure.
Figure 2:
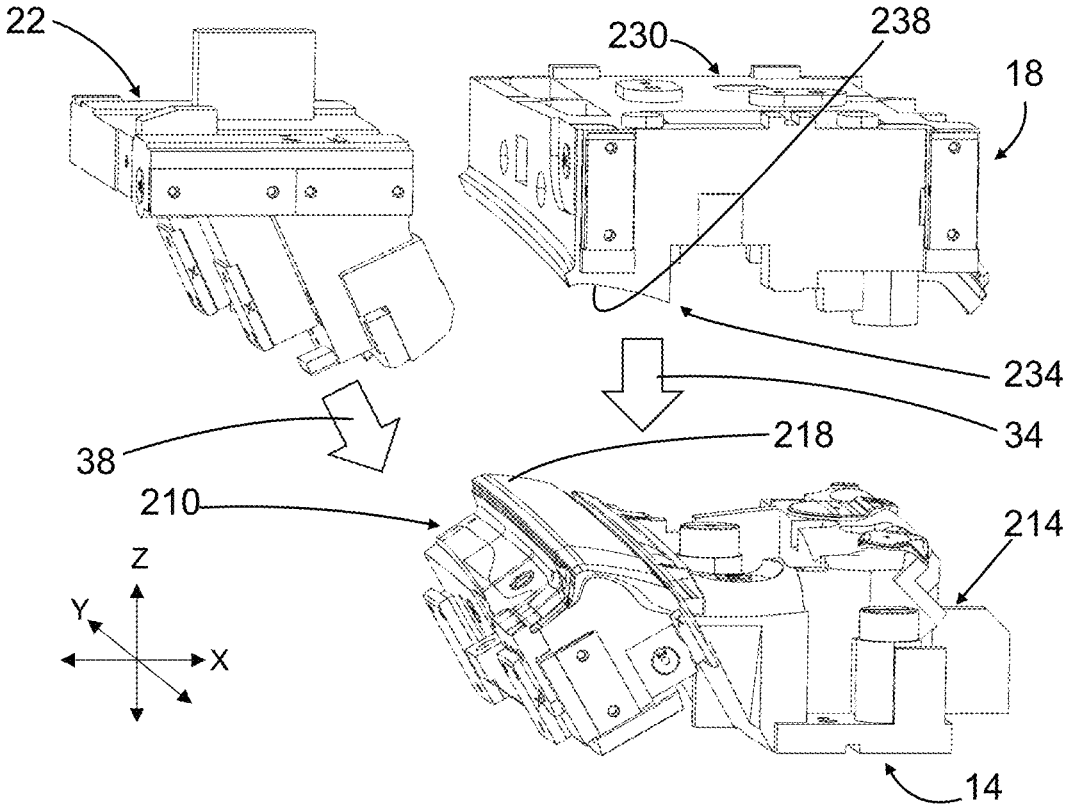
FIG. 2 is a perspective view of a portion of the stamping tool of FIG. 1, illustrating an upper forming assembly, an upper pad, and a lower pad in retracted positions according to the teachings of the present disclosure.
Figure 6:
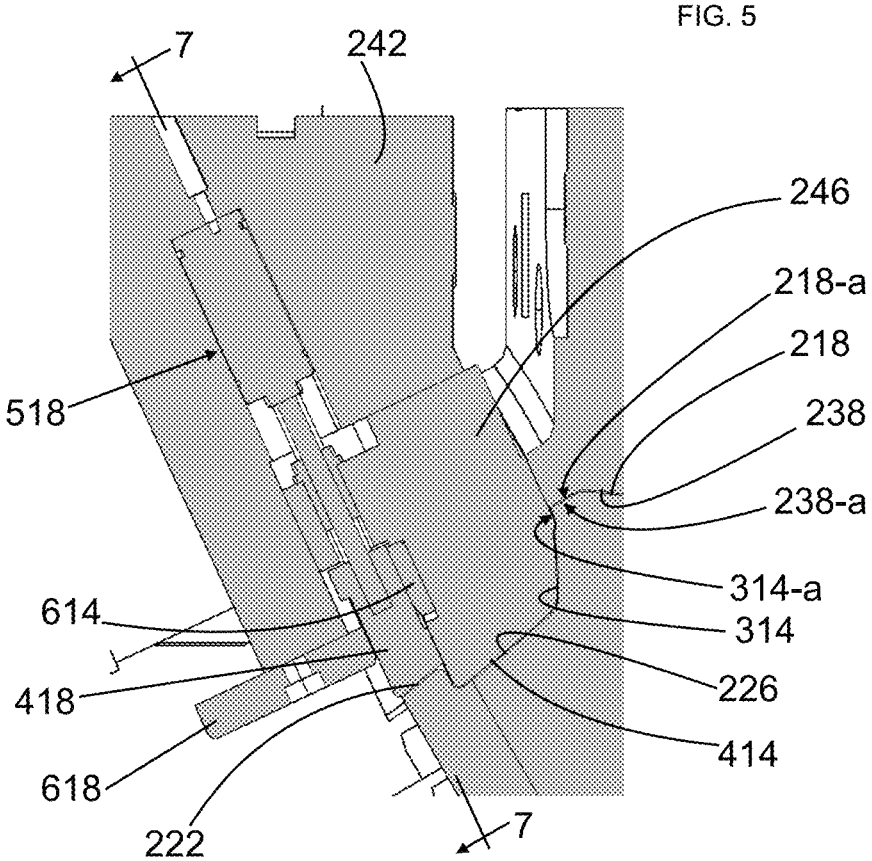
FIG. 6 is a cross-sectional view of the upper forming assembly of FIG. 2, illustrated in a final position relative to the upper pad and the lower pad in accordance with the teachings of the present disclosure.
Figure 7:
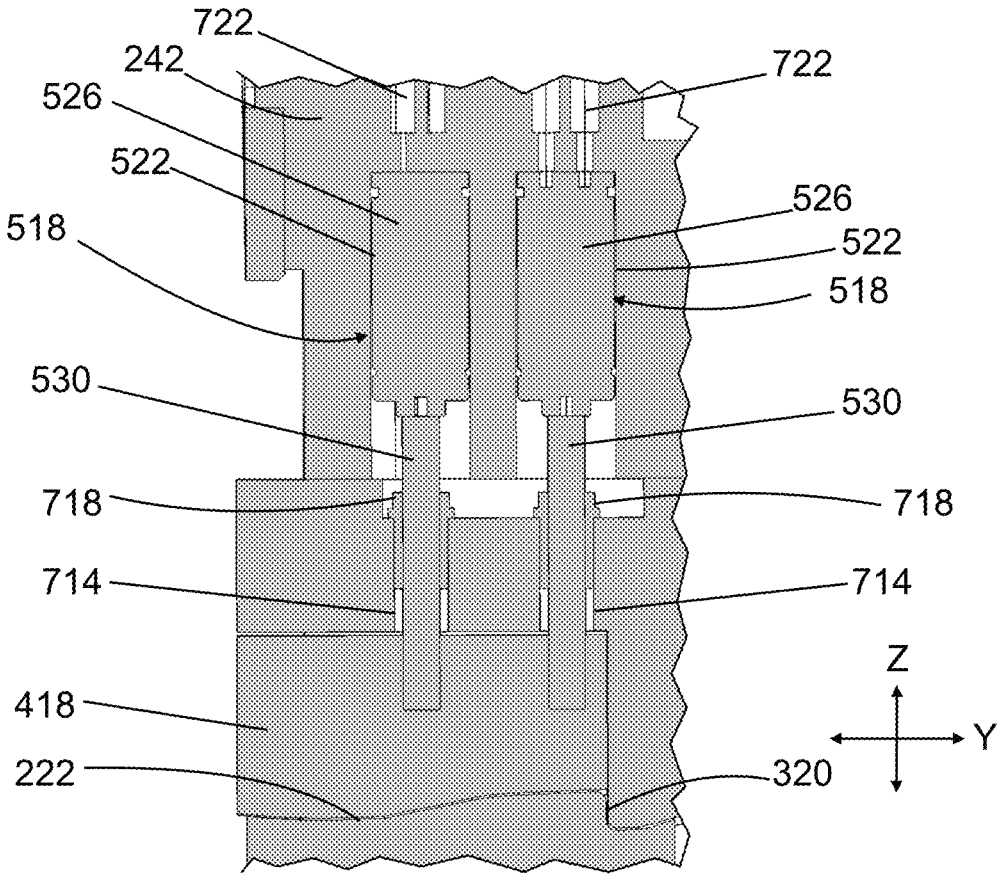
Figure 8:
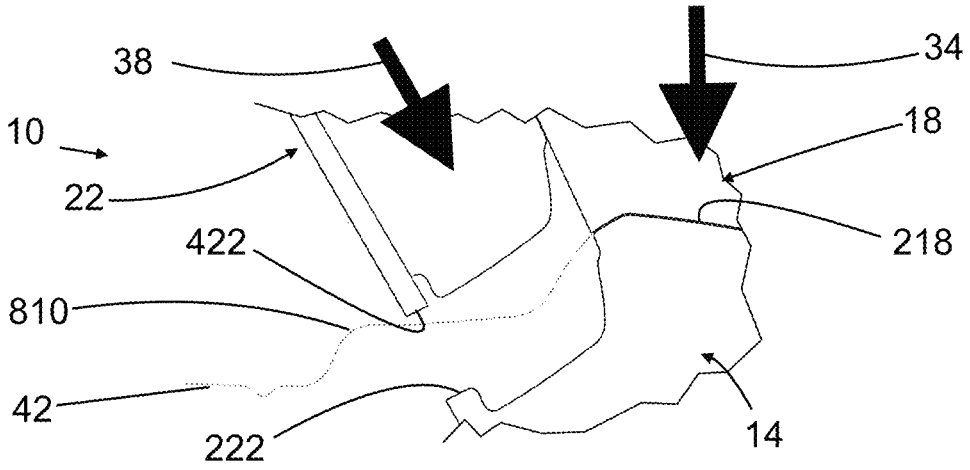
Figure 9:
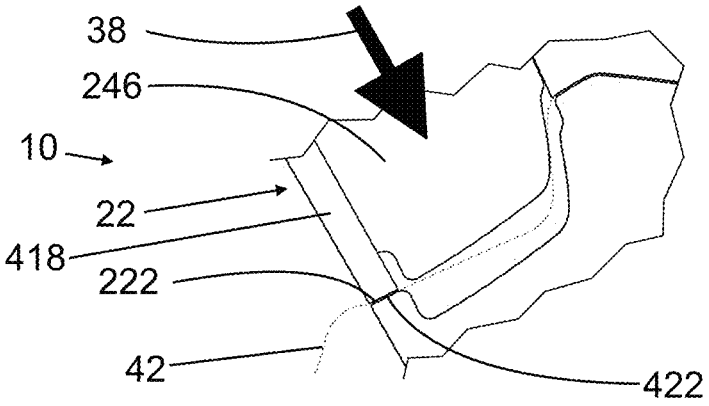
Figure 10:
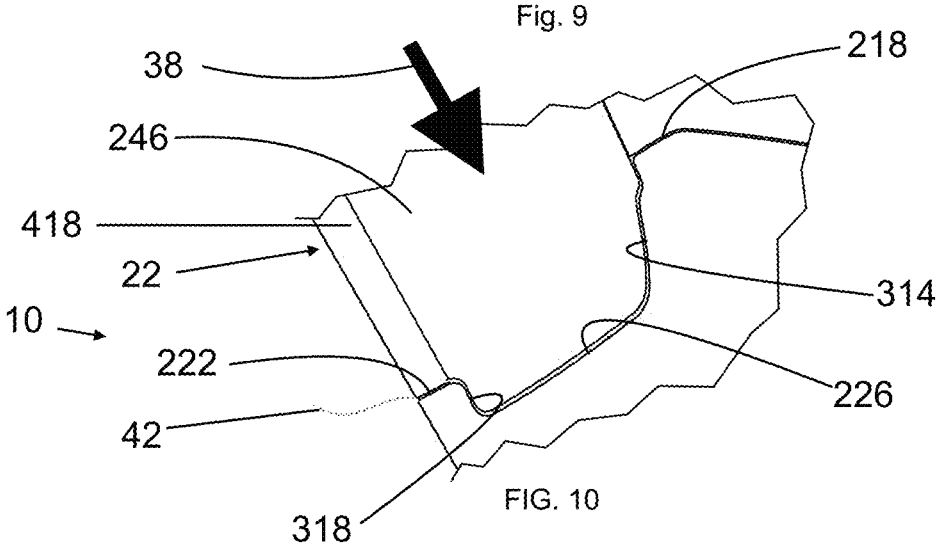

FIG. 7 is a cross-sectional view of the upper forming assembly of FIG. 2 in the final position relative to the upper pad and the lower pad, taken along line 7-7 shown in FIG. 6; and FIGS. 8-10 are schematic cross-sectional views of the stamping tool of FIG. 1, illustrating the upper pad, upper forming assembly, and lower pad in sequential positions during a forming process according to the teachings of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Referring to FIG. 1, a stamping machine or stamping tool 10 is schematically illustrated. The stamping tool includes a lower pad 14, an upper pad 18, and an upper forming assembly 22. In the example provided, the lower pad 14 is configured to remain stationary while the upper pad 18 and upper forming assembly 22 move relative to the lower pad 14 and relative to each other during the forming process. In an alternative form, not specifically shown, the lower pad 14 may be configured to move or may be an assembly of components, some of which may be configured to move relative to others during the forming process.

In the example provided the upper pad 18 and upper forming assembly 22 are supported above the lower pad 14 by a hydraulic press frame 26 of the stamping tool 10. Hydraulic components 30 (e.g., piston-cylinders) of the frame 26 are configured to move the upper pad 18 relative to the lower pad 14 along a second direction 34 and to move the upper forming assembly 22 relative to the lower pad 14 along a first direction 38 that is transverse to the second direction 34. The hydraulic components 30 are configured to move the upper forming assembly 22 independent of the upper pad 18. The hydraulic components 30 are configured to move the upper pad 18 until a workpiece 42 is clamped between the upper pad 18 and the lower pad 14. The hydraulic components 30 are configured to move the upper forming assembly 22 to deform the workpiece 42 against the lower pad 14. While described herein with reference to hydraulic components, it is understood that the upper pad 18 and/or the upper forming assembly 22 can be moved by other devices such as mechanical linkages.

In the example provided, the workpiece 42 is a sheet metal material and may be any suitable material such as steel or aluminum for example. The workpiece 42 may be a flat sheet before being inserted into the stamping tool 10 or may have already undergone some forming or previous stamping such that the workpiece 42 includes one or more bends 810, as shown in FIG. 8, to have a three-dimensional shape before being operated on by the stamping tool 10. In one form, not specifically shown, the workpiece 42 is flat but has undergone a blanking process to trim the workpiece into a two-dimensional shape before being operated on by the stamping tool 10.

Referring to FIG. 2, the lower pad 14, the upper pad 18, and the upper forming assembly 22 are illustrated in greater detail. The lower pad 14 includes a base portion 210 and a working portion 214 coupled to the base portion 210. The working portion 214 is coupled to the base portion 210 and is configured to engage the workpiece 42 (FIG. 1). The base portion 210 supports the working portion 214 during operation of the stamping tool 10. In one form, the base portion 210 supports the working portion 214 rigidly such that the working portion 214 does not move when the workpiece 42 (FIG. 1) is pressed against it by the upper pad 18 and the upper forming assembly 22, though other configurations can be used, such as being able to move a predetermined amount relative to the base portion 210 when the workpiece 42 (FIG. 1) is pressed against it. In the example provided, the second direction 34 is along the Z axis and the first direction 38 has an X axis component and a Z axis component but is coplanar in the Y direction, though other configurations can be used. For example, the first direction 38 may also have a Y component relative to the second direction 34. As shown, the X, Y, and Z axes are understood to be perpendicular to each other.

Figure 3:
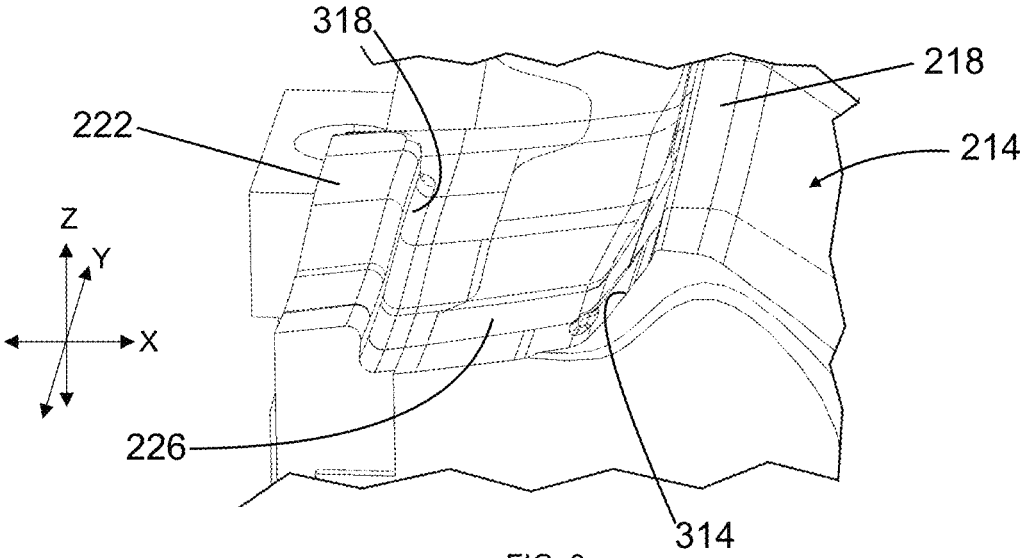
FIG. 3 is a perspective view of a portion of the lower pad of FIG. 2.

With additional reference to FIG. 3, the working portion 214 includes a first lower clamp surface 218, a second lower clamp surface 222, and a lower forming surface 226 that is recessed between the first and second lower clamp surfaces 218, 222. In a general sense, the first lower clamp surface 218 faces opposite the second direction 34, though it should be understood that it or its entirety may not face exactly parallel to the second direction 34. In the example provided, the first lower clamp surface 218 has an overall smooth, convex, curved shape. In the example provided, as best shown in FIG. 6, the first lower clamp surface 218 can have a portion 218-*a* that is substantially flat and faces opposite the second direction 34.

Returning to FIGS. 2 and 3, in a general sense, the second lower clamp surface 222 faces opposite the first direction 38, though it should be understood that it or its entirety may not face exactly parallel to the first direction 38. In the example provided the second lower clamp surface 222 has a smooth, curved shape. In the example provided, as best shown in FIG. 6, the second lower clamp surface 222 has a slight angle relative to the first direction 38 such that it faces slightly away from the lower forming surface 226, though other configurations can be used. As best shown in FIG. 7, the second lower clamp surface 222 may also have a curved Z axis profile as it extends along the Y axis. In other words, a height of the second lower clamp surface 222 above the lower forming surface 226 may change along the Y axis. The height may also change along the X axis.

Returning to FIG. 3, the second lower clamp surface 222 is spaced apart from the first lower clamp surface 218 by the lower forming surface 226. In other words, the first lower clamp surface 218 and the second lower clamp surface 222 are at opposite sides of the lower forming surface 226. The lower forming surface 226 transitions to the first lower clamp surface 218 via a first side surface 314. In the example provided, the first side surface 314 is ramped to form a gentle transition from the lower forming surface 226 to the first lower clamp surface 218, though other configurations can be used. In other words, the first side surface 314 can generally form an obtuse angle with the lower forming surface 226, though other configurations may use a right angle or an acute angle. In the example provided, as best shown in FIG. 6, the first side surface 314 may have a portion 314-*a* adjacent to the portion 218-*a* that is substantially perpendicular to the portion 218-*a*, though other configurations can be used.

Returning to FIG. 3, the lower forming surface 226 transitions to the second lower clamp surface 222 via a second side surface 318. In the example provided, the second side surface 318 forms a more abrupt transition between the lower forming surface 226 and the second lower clamp surface 222. In the example provided, the second side surface 318 generally forms an acute angle with the lower forming surface 226 such that the second lower clamp surface 222 partially overhangs the lower forming surface 226, though other configurations can be used, such as a right angle or an obtuse angle without an overhang, for example.

In the example provided, the first lower clamp surface 218 extends further in the +Y direction than the second lower clamp surface 222. The lower forming surface 226 can border two sides (e.g., via the second side surface 318 and a third side surface 320, shown in FIG. 7) of the second lower clamp surface 222. In an alternative form, not specifically shown, the lower forming surface 226 may wrap around three or four sides of the second lower clamp surface 222.

Returning to FIG. 2, the upper pad 18 includes a base portion 230 and a working portion 234. The base portion 230 supports the working portion 234 and is driven by the hydraulic components 30 (FIG. 1) to move the working portion 234 in the second direction 34. The working portion 234 includes an first upper clamp surface 238 that faces toward and opposes the first lower clamp surface 218 of the lower pad 14. The first upper clamp surface 238 has a contour that complements the contour of the first lower clamp surface 218. In the example provided, the first upper clamp surface 238 has a concave contour and the first lower clamp surface 218 has a convex contour that nests therein, though other configurations can be used. In the example provided, as best shown in FIG. 6, the first upper clamp surface 238 can have a portion 238-*a* that is parallel to and opposes the portion 218-*a*.

In one form, a portion of the workpiece 42 (FIG. 1) to be clamped by the upper pad 18 can have a contour that substantially matches the contours of the first upper clamp surface 238 and the first lower clamp surface 218 such that the clamping therebetween does not substantially deform the workpiece 42. In another form, the workpiece 42 (FIG. 1) may be deformed by being clamped by the upper pad 18.

Figure 4:
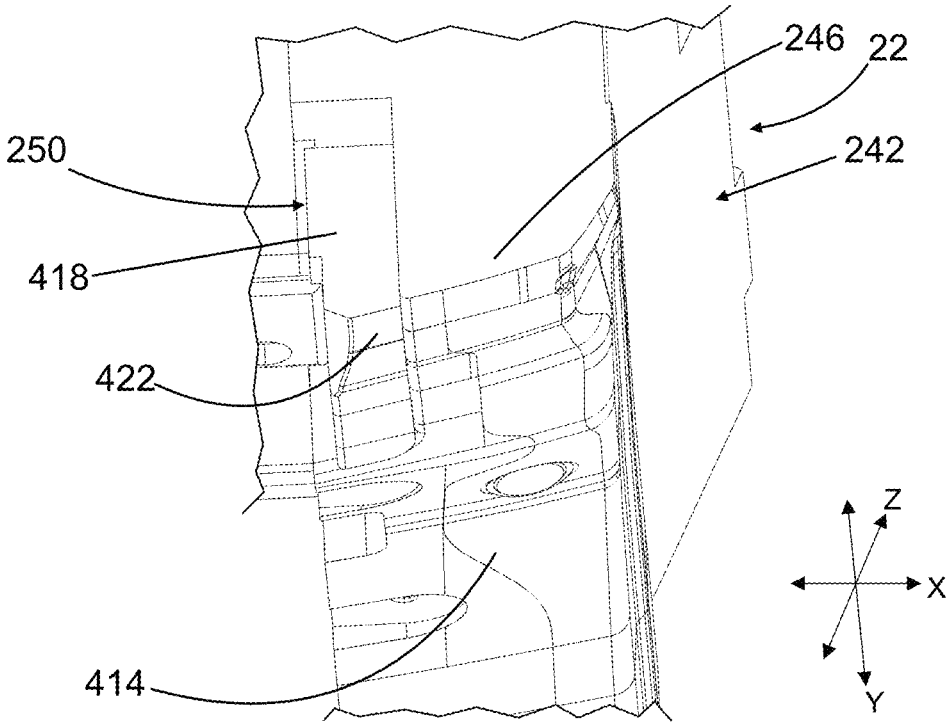
FIG. 4 is a perspective view of a portion of the upper forming assembly of FIG. 2.
Figure 5:
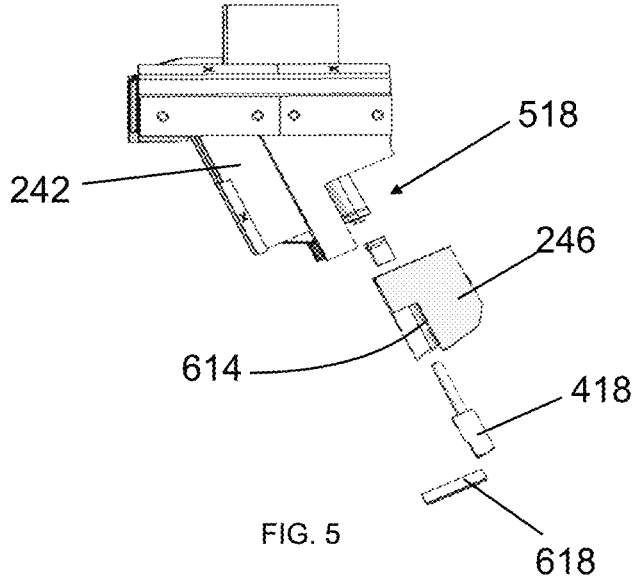
FIG. 5 is an exploded side view of the upper forming assembly of FIG. 2.

Referring to FIGS. 2 and 4, the upper forming assembly 22 includes a base portion 242, a forming steel 246, and a sub-pad assembly 250. The base portion 242 supports the forming steel 246 and the sub-pad assembly 250 and is driven by the hydraulic components 30 (FIG. 1) to move the forming steel 246 and the sub-pad assembly 250 in the first direction 38.

Referring to FIGS. 4 and 6, the forming steel 246 is fixedly coupled to the base portion 242 and has an upper forming surface 414 configured to be received in the recess between the first and second lower clamp surfaces 218, 222 and deform the workpiece 42 when received therein. The upper forming surface 414 has a contour that mates with the contour of the lower forming surface 226. In the example provided, the contour of the upper forming surface 414 also mates with the contour of the first side surface 314 (FIG. 3) and the second side surface 318 (FIG. 3). In the example provided, the contour of the upper forming surface 414 also mates with the contour of the third side surface 320 (FIG. 7).

Referring to FIGS. 4-7, the sub-pad assembly 250 includes a sub-pad body 418 and at least one biaser or biasing device 518. The sub-pad body 418 is coupled to the base portion 242 and the forming steel 246 in a manner that permits the sub-pad body 418 to translate along the first direction 38 (FIG. 2) relative to the forming steel 246 and the base portion 242 between an extended position (shown in FIGS. 2, 4, 8 and 9), and a retracted position (shown in FIGS. 6, 7, and 10). The biasing device(s) 518 bias the sub-pad body 418 toward the extended position. The sub-pad body 418 includes a second upper clamp surface 422 that has a contour that generally matches and opposes the second lower clamp surface 222 and is configured to clamp the workpiece 42 (FIG. 1) therebetween. In the example provided, the workpiece 42 (FIG. 1) already has a contour substantially matching the contour of the second upper clamp surface 422 and the second lower clamp surface 222 such that the workpiece is not deformed by the clamping therebetween. In an alternative form, not specifically shown, the workpiece 42 (FIG. 1) may be deformed when clamped therebetween.

In the example provided, the sub-pad body 418 is in sliding contact with a thrust plate 614 that is fixedly mounted to the forming steel 246 and a keeper plate 618 that is fixedly mounted to the base portion 242 on an opposite side of the sub-pad body 418 from the thrust plate 614, though other configurations can be used, such as bearings and/or direct sliding contact with the base portion 242 and/or the forming steel 246 for example.

In the example provided, as best shown in FIG. 4, the second upper clamp surface 422 is bordered on two sides by the forming steel 246. In an alternative configuration, not specifically shown, the second upper clamp surface 422 may be bordered by the forming steel 246 on only one side or on three or more sides. In one alternative configuration, not specifically shown, the second upper clamp surface 422 may be completely surrounded by the forming steel 246.

In the example provided, as best shown in FIG. 7, the sub-pad assembly 250 includes two biasing devices 518, though other configurations can be used such as one biasing device or more than two. In the example provided, each biasing device 518 is a piston-cylinder assembly that includes a cylinder 522, a piston 526, and a rod 530. The cylinder 522 is fixedly coupled to the base portion 242. In the example provided, each cylinder 522 is a bore formed in the base portion 242 such that each cylinder 522 is defined by the base portion 242, though other configurations can be used such as a separate cylinder body mounted to the base portion 242. Each piston 526 is received in a corresponding cylinder 522 and is configured to slide therein along a central axis of the cylinder 522 between an extended position (shown in FIGS. 2, 4, 8 and 9), and a retracted position (shown in FIGS. 6, 7, and 10). The central axis is parallel to the first direction 38 (FIG. 2). Each rod 530 extends from a first end of the rod 530 fixedly attached to a corresponding piston 526 to a second end of the rod 530 fixedly attached to the sub-pad body 418 so that the sub-pad body 418 moves in the first direction 38 (FIG. 2) with the piston 526 and rod 530.

Each rod 530 may extend through a corresponding bore 714 defined in the forming steel 246. In the example provided, each rod 530 is in sliding contact with a bushing 718 disposed about the rod 530 and seated in the bore 714.

In the example provided, each cylinder 522 is pressurized with a gas (e.g., air, nitrogen) from a side of the piston 526 that is opposite the rod 530 (e.g., via passageways 722). As such, the piston 522 is biased toward the extended position. In an alternative form, pressurized liquid may be used. In another alternative form, a mechanical spring (e.g., coil spring, Belleville spring, resilient body) may be used with the cylinder 522, piston 526, and rod 530 or such a spring may be used as the biasing device 518 instead of the piston-cylinder arrangement.

Referring to FIGS. 8-10, sequential steps in operation of the stamping tool 10 are illustrated. Before FIG. 8, the workpiece 42 is inserted between the lower pad 14 and the upper pad 18, with the upper pad 18 in the retracted position (shown in FIG. 2). In this position, the workpiece 42 is also between the lower pad 14 and the upper forming assembly 22 with the upper forming assembly 22 in its retracted position. As shown in FIG. 8, the upper pad 18 is moved along the second direction 34 until it clamps the workpiece 42 against the first lower clamp surface 218.

Next, the base portion 242 (FIG. 2) of the upper forming assembly 22 is moved in the first direction 38 such that the forming steel 246 and the sub-pad body 418 are moved together in the first direction 38 until they reach an intermediate position shown in FIG. 9. In this intermediate position, the workpiece 42 is clamped between the second upper clamp surface 422 and the second lower clamp surface 222. Some deformation of the workpiece 42 may or may not take place to reach this intermediate position.

Next, the base portion 242 (FIG. 2) continues to move in the first direction 38 to move the forming steel 246 further in the first direction 38. During this step, the sub-pad body 418 continues to clamp the workpiece 42 while the forming steel 246 is received into the recess between the first and second lower clamp surfaces 218, 222. As such, the biasing device(s) 518 (FIGS. 5-7) permit the forming steel 246 to continue to move in the first direction 38 while the sub-pad body 418 remains stationary in this step. Thus, the workpiece 42 is deformed between the first and second lower clamp surfaces 218, 222. The forming steel 246 may press the workpiece 42 against the lower forming surface 226. The forming steel 246 may also press the workpiece 42 against the first side surface 314, the second side surface 318, and/or the third side surface 320 (FIG. 7).

Next, the movements of the upper forming assembly 22 and the upper pad 18 are reversed to release the workpiece 42 from the stamping tool 10.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A stamping tool for forming a panel from a sheet metal workpiece, the stamping tool comprising:

at least one lower pad including a first lower pad surface, a lower forming surface, and a second lower pad surface, the lower forming surface at least partially defining a recess between the first lower pad surface and the second lower pad surface, the recess being recessed in a first direction from the first lower pad surface and the second lower pad surface;

an upper pad including a first upper clamp surface, the upper pad being movable relative to the at least one lower pad along a second direction between a retracted pad position and an extended pad position, wherein in the extended pad position, the first upper clamp surface is configured to hold the workpiece against the first lower pad surface, wherein in the retracted pad position, the first upper clamp surface is further from the first lower pad surface than when in the extended pad position;

a forming steel including a first forming surface, the forming steel being movable relative to the at least one lower pad along the first direction between a retracted steel position, an extended steel position, and an intermediate steel position that is between the retracted steel position and the extended steel position, wherein in the extended steel position, the first forming surface is received in the recess, wherein in the retracted steel position, the first forming surface is further from the lower forming surface than when in the extended steel position; and a sub-pad including a second upper clamp surface opposing the second lower pad surface, the sub-pad being coupled to the forming steel such that the forming steel moves the sub-pad in the first direction as the forming steel moves from the retracted steel position to the intermediate steel position and, at the intermediate steel position, the sub-pad is configured to hold the workpiece against the second lower pad surface while the forming steel continues to move to the extended position.

2. The stamping tool according to claim 1, further comprising a biaser that biases the sub-pad relative to the forming steel in the first direction toward the second lower pad surface.

3. The stamping tool according to claim 2, wherein the biaser includes at least one of a piston-cylinder assembly and a spring.

4. The stamping tool according to claim 2, wherein a biasing force of the biaser is adjustable.

5. The stamping tool according to claim 1, wherein the sub-pad is nested within the forming steel such that at least two side surfaces of the sub-pad oppose at least two side surfaces of the forming steel.

6. The stamping tool according to claim 5, wherein the at least two side surfaces of the sub-pad includes three side surfaces that oppose three side surfaces of the at least two side surfaces of the forming steel.

7. The stamping tool according to claim 1, wherein the sub-pad is surrounded by the forming steel except for in the first direction.

8. The stamping tool according to claim 1, further comprising a thrust plate coupled to one of the forming steel and the sub-pad and configured to slidingly engage the other of the forming steel and the sub-pad.

9. The stamping tool according to claim 8, further comprising a keeper plate coupled to the forming steel and configured to slidingly engage a side of the sub-pad that is opposite the thrust plate.

10. The stamping tool according to claim 1, wherein the first lower pad surface, the lower forming surface, and the second lower pad surface are surfaces on a common lower pad of the at least one lower pad.

11. The stamping tool according to claim 1, wherein an edge of the first lower pad surface aligns with an edge of the recess and an edge of the second lower pad surface aligns with a different edge of the recess.

12. The stamping tool according to claim 1, wherein when the forming steel is in the retracted position, the first forming surface is aligned with the second upper clamp surface.

13. The stamping tool according to claim 1, wherein the second direction is transverse to the first direction.

14. The stamping tool according to claim 13, wherein the first direction and the second direction are coplanar.

15. The stamping tool according to claim 1, wherein the forming steel further includes a second form surface on an opposite side of the sub-pad as the first forming surface.

16. A stamping tool for forming a panel from a sheet metal workpiece, the stamping tool comprising:

a lower pad including a first lower pad surface, a lower forming surface, and a second lower pad surface, the lower forming surface at least partially defining a recess between the first lower pad surface and the second lower pad surface, the recess being recessed in a first direction from the first lower pad surface and the second lower pad surface;

an upper pad including a first upper clamp surface, the upper pad being movable relative to the lower pad along a second direction between a retracted pad position and an extended pad position, the second direction being transverse to the first direction, wherein in the extended pad position, the first upper clamp surface is configured to hold the workpiece against the first lower pad surface, wherein in the retracted pad position, the first upper clamp surface is further from the first lower pad surface than when in the extended pad position;

a forming steel including a first forming surface, the forming steel being movable relative to the lower pad along the first direction between a retracted steel position, an extended steel position, and an intermediate steel position that is between the retracted steel position and the extended steel position, wherein in the extended steel position, the first forming surface is received in the recess, wherein in the retracted steel position, the first forming surface is disposed outside of the recess;

a sub-pad including a second upper clamp surface opposing the second lower pad surface, the sub-pad being coupled to the forming steel such that the forming steel moves the sub-pad in the first direction as the forming steel moves from the retracted steel position to the intermediate steel position and, at the intermediate steel position, the sub-pad is configured to hold the workpiece against the second lower pad surface while the forming steel continues to move to the extended position; and a biaser that biases the sub-pad relative to the forming steel in the first direction toward the second lower pad surface.

17. The stamping tool according to claim 16, wherein the sub-pad is nested within the forming steel such that at least two side surfaces of the sub-pad oppose at least two side surfaces of the forming steel.

18. A method of forming a panel from a sheet metal workpiece, the method including:

positioning the workpiece on a lower pad;

clamping a first portion of the workpiece between an upper pad and a first lower pad surface of the lower pad; and moving a base of a first forming steel in a first direction from a retracted steel position, through an intermediate steel position, to an extended steel position such that the base moves a sub-pad in the first direction while moving from the retracted steel position to the intermediate steel position, the sub-pad clamps a third portion of the workpiece to a second lower pad surface of the lower pad while the base moves from the intermediate position to the extended position, and a first forming surface of the first forming steel deforms a second portion of the workpiece on a second forming surface of the lower pad, that is between the first lower pad surface and the second lower pad surface, by extending further in the first direction than the sub-pad, wherein the second forming surface of the lower pad is recessed in the first direction from the first lower pad surface and the second lower pad surface.

19. The method according to claim 18, wherein the sub-pad remains stationary as the base moves from the intermediate steel position to the extended steel position.

* * * * *